US006824011B1

(12) United States Patent
Woempner

(10) Patent No.: US 6,824,011 B1
(45) Date of Patent: Nov. 30, 2004

(54) PELLET DISPENSER AND METHOD

(75) Inventor: Ken R. Woempner, Thomasville, NC (US)

(73) Assignee: Woempner Machine Company, Inc., Thomasville, NC (US)

( * ) Notice: Subject to any disclaimer, the term of this patent is extended or adjusted under 35 U.S.C. 154(b) by 237 days.

(21) Appl. No.: 09/954,898

(22) Filed: Sep. 19, 2001

(51) Int. Cl.[7] ..... B65G 59/00; B65H 3/00; G07F 11/00

(52) U.S. Cl. ..... 221/265; 221/263; 221/264; 221/289

(58) Field of Search ..... 221/119, 121, 221/123, 298, 299, 265, 263, 264, 289, 79, 87, 88, 83, 82, 283; 42/87, 88, 89, 90

(56) References Cited

U.S. PATENT DOCUMENTS

| | | | | | |
|---|---|---|---|---|---|
| 2,436,075 | A | * | 2/1948 | Orban | 312/47 |
| 2,759,632 | A | * | 8/1956 | Ussery et al. | 221/199 |
| 2,865,156 | A | * | 12/1958 | Wolfson | 53/237 |
| 3,115,992 | A | * | 12/1963 | Menolasino et al. | 221/264 |
| 3,162,287 | A | * | 12/1964 | Lupovici | 221/121 |
| 3,810,535 | A | * | 5/1974 | Phipps | 194/85 |
| 3,963,456 | A | * | 6/1976 | Tsuchia et al. | 29/203 |
| 3,991,908 | A | * | 11/1976 | Thomas et al. | 221/254 |
| 4,101,284 | A | * | 7/1978 | Difiglio et al. | 33/16 |
| 4,173,211 | A | | 11/1979 | Crawford, Jr. | |
| 4,228,920 | A | * | 10/1980 | Burton | 221/265 |
| 4,405,060 | A | * | 9/1983 | Hsei | 221/135 |
| 4,461,225 | A | * | 7/1984 | Patrick | 111/95 |
| 4,485,938 | A | * | 12/1984 | Williams | 221/154 |
| 4,512,500 | A | * | 4/1985 | Belbin, Sr. | 221/82 |
| 4,613,057 | A | * | 9/1986 | Sacchetti et al. | 221/265 |
| 4,653,668 | A | * | 3/1987 | Gibilisco et al. | 221/298 |
| 4,763,812 | A | * | 8/1988 | Sekinoo et al. | 221/203 |
| 4,767,023 | A | * | 8/1988 | Hackmann et al. | 221/152 |
| 4,782,980 | A | * | 11/1988 | Heimlich et al. | 221/265 |
| 4,831,998 | A | | 5/1989 | Maguire, III | |
| 4,854,478 | A | * | 8/1989 | Gyimothy | 221/190 |
| 5,081,781 | A | * | 1/1992 | Kanyuck et al. | 42/90 |
| 5,246,138 | A | * | 9/1993 | Blevins, Jr. | 221/191 |
| 5,323,929 | A | * | 6/1994 | Marlar | 221/3 |
| 5,363,984 | A | * | 11/1994 | Laird, III | 221/24 |
| 5,397,017 | A | * | 3/1995 | Muza et al. | 221/9 |
| 5,522,525 | A | * | 6/1996 | McLaughlin et al. | 221/4 |
| 5,664,697 | A | * | 9/1997 | Lambelet, Jr. et al. | 221/5 |
| 5,791,515 | A | * | 8/1998 | Khan et al. | 221/154 |
| 6,170,229 | B1 | * | 1/2001 | Kim | 53/155 |
| 6,208,911 | B1 | * | 3/2001 | Yamaoka et al. | 700/242 |
| 6,394,308 | B1 | * | 5/2002 | Yuyama et al. | 221/265 |
| 6,431,399 | B2 | * | 8/2002 | Gabel et al. | 221/263 |
| 6,497,342 | B2 | * | 12/2002 | Zhang et al. | 221/265 |

FOREIGN PATENT DOCUMENTS

| | | | | |
|---|---|---|---|---|
| DE | 3741960 A1 | * | 6/1989 | B65D/83/04 |
| GB | 2361471 A | * | 10/2001 | B65D/83/04 |

* cited by examiner

*Primary Examiner*—Donald P. Walsh
*Assistant Examiner*—Michael E. Butler

(57) ABSTRACT

A pellet dispensing device includes a rotatable cylinder having a plurality of chambers and a trigger mechanism for dispensing pellets therefrom, one at a time. The device further includes a clasp for attachment to the belt or otherwise of a wearer where it is readily accessible. Pellets are placed in a hopper atop the rotatable cylinder which allows each chamber to be completely filled. A resilient member engages each pellet before it passes through an exit conduit to insure single pellet dispensing.

14 Claims, 3 Drawing Sheets

PELLET DISPENSER AND METHOD

FIELD OF THE INVENTION

The invention herein pertains to dispensing pellets used in pellet rifles and pistols and particularly pertains to a dispenser which can be worn on the belt of the user for convenience.

DESCRIPTION OF THE PRIOR ART AND OBJECTIVES OF THE INVENTION

Target practice using air and spring operated pellet guns in recent years has become increasingly popular. Many pellet guns require a single pellet to be inserted each time after the gun is fired. Shooters in the past have often carried pellets in a loose fashion within their pockets or container. Some mechanical devices have also been tried with varying degrees of success for loading pellets directly into air operated guns. However, it is generally preferred to load pellet guns and the like by hand, especially for single shot rifles and pistols. However, the carrying of loose pellets is troublesome as lead pellets can be easily distorted during handling, making loading difficult and time consuming. Also, a loose pellet requires a certain degree of dexterity to be manually picked up especially if the fingers are cold during winter shooting.

Thus, with the problems associated with the prior pellet loading devices and realizing the needs which currently exist, the present invention was conceived and one of its objectives is to provide a handy pellet dispensing device which can be worn on the shooter's side for example, on the belt of the shooter.

It is another objective of the present invention to provide a pellet dispensing device and method of operation which will consistently deliver one pellet at a time, without jamming.

It is still another objective of the present invention to provide a pellet dispensing device which can be loaded with a large number of pellets selected for a particular caliber gun.

It is yet another objective of the present invention to provide a pellet dispensing device and method of operation which allows easy loading and trouble-free dispensing.

It is still a further objective of the present invention to provide a pellet dispensing device which is relatively inexpensive to manufacture and purchase.

It is another objective of the present invention to provide a pellet dispensing device which helps reduce exposure to lead by eliminating excess pellet handling.

Various other objectives and advantages of the present invention will become apparent to those skilled in the art as a more detailed description is set forth below.

SUMMARY OF THE INVENTION

The aforesaid and other objectives are realized by a pellet dispensing device preferably formed from aluminum and stainless steel. The dispensing device includes an outer aluminum housing having a clasp for convenient attachment to the belt of the wearer. A rotatable cylinder formed from aluminum having multiple pellet chambers is contained within the housing and includes a hopper positioned at the top thereof having a sloped bottom which is in communication with the pellet chambers. A threaded cap closes the hopper once the chambers have been loaded. To actuate the pellet dispenser a trigger is pressed which is located within the housing bottom. One pellet is then dispensed at a time through an exit conduit for use as ammunition in an air operated gun. On the bottom of the cylinder a series of detents or depressions are arranged in a circular fashion. A spring loaded sphere is mounted in the bottom of the housing which engages each detent in succession as the cylinder is rotated to insure precise chamber alignment with the exit conduit. To prevent more than one pellet being dispensed at a time, a means to engage a pellet in the form of a coil spring is attached to the trigger. The coil spring passes through an opening in the wall of the exit conduit to engage various sized lead pellets as are utilized from 0.177 to 0.250 caliber, so only one pellet at a time is dispensed.

DETAILED DESCRIPTION OF THE PREFERRED EMBODIMENTS AND OPERATION OF THE INVENTION

Figure 4:
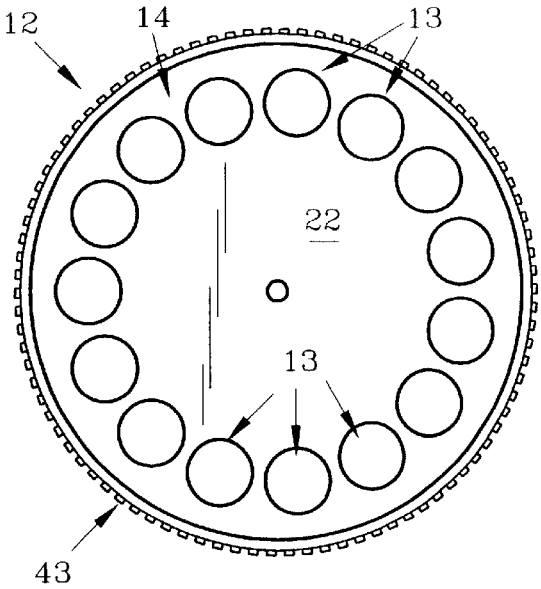
FIG. 4 shows a top view of the cylinder with the cap removed as along lines 4—4 of FIG. 2.
Figure 5:
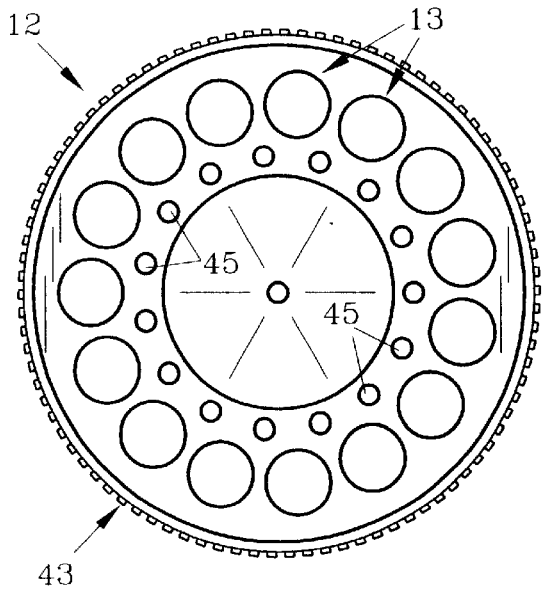
FIG. 5 shows a bottom view of the cylinder as along lines 5—5 of FIG. 2.
Figure 1:
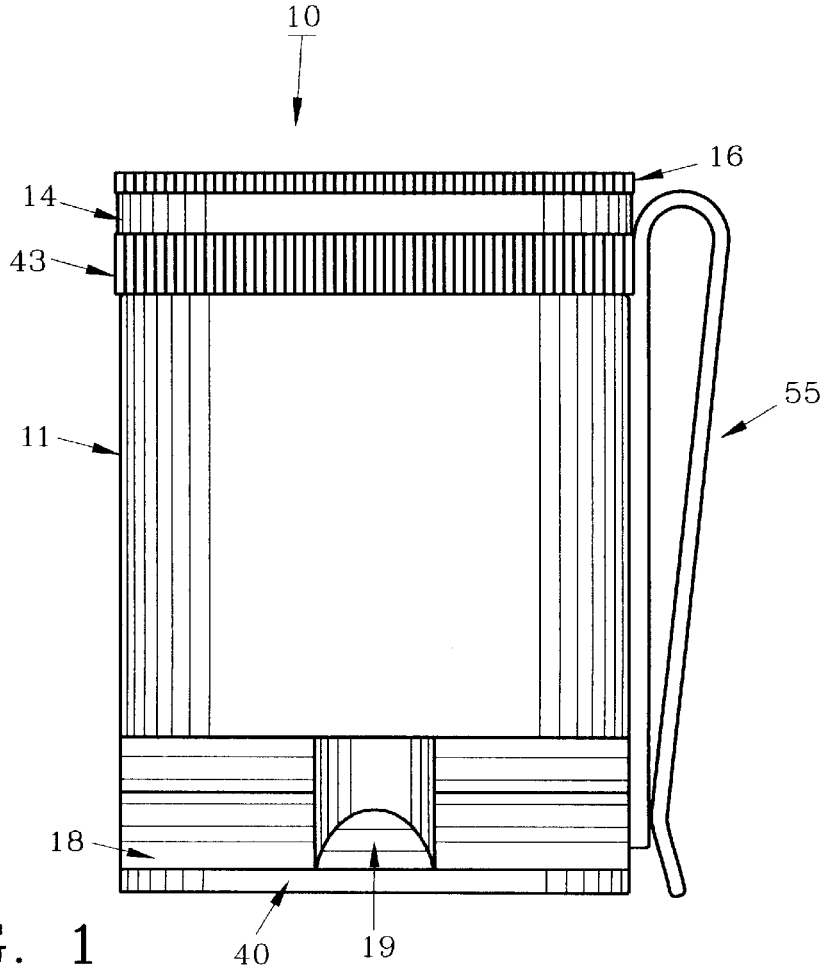
FIG. 1 shows a rear elevational view of the dispensing device of the invention as removed from a belt or other article.
Figure 2:
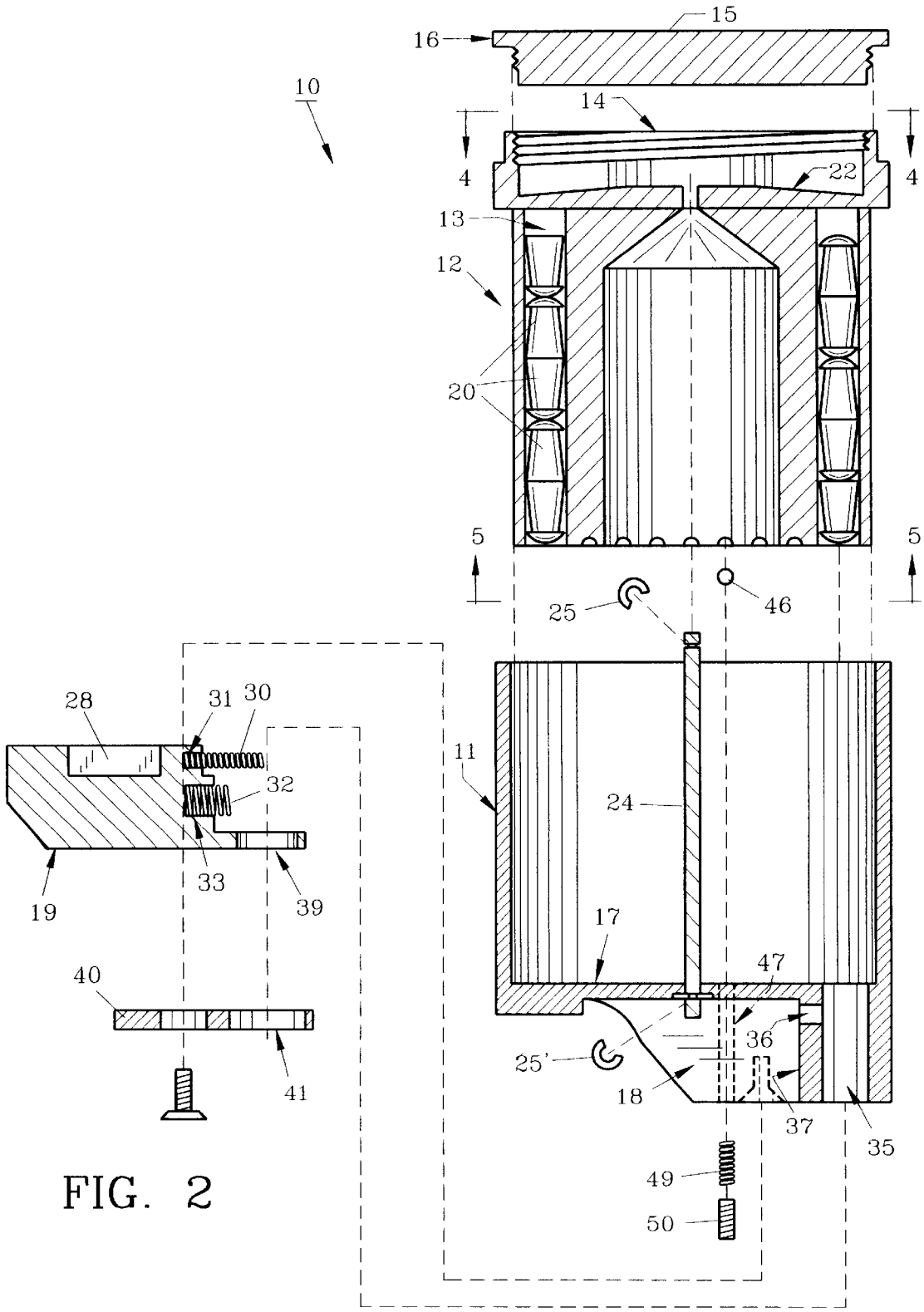
FIG. 2 demonstrates a cross-sectional exploded side view of the dispensing device as seen in FIG. 1.

For a better understanding of the invention and its operation, turning now to the drawings, the preferred embodiment is illustrated in FIGS. 1–5 which shows pellet dispensing device 10 in FIGS. 1 and 2 having an outer housing 11 containing rotatable cylinder 12 therein. Cylinder 12 defines fifteen pellet chambers 13 as shown in FIG. 5 although other numbers of chambers and sizes could be utilized as desired. Atop cylinder 12 is hopper 14 for holding a multiplicity of pellets 20 for convenience and ease in loading chambers 13. Hopper 14 has a sloped bottom 22 which encourages pellets 20 to roll toward apertures 23 during loading and includes a plurality of interior threads for releasable engagement with threaded cap 15, as shown in more detail in FIG. 2. Dispensing device 10 is preferably, mainly formed by machining aluminum, although other suitable methods, metals and materials such as plastic may be used. Dispensing device 10 is preferably 2.25 inches (5.71 cm) in height with an outer diameter of 1.625 inches (4.12 cm) for a 0.177 caliber pellet dispenser.

In FIG. 2 a cross-sectional view of preferred pellet dispensing device 10 is shown in exploded fashion. Cap 15 having a knurled periphery 16 is removed from hopper 14 so pellets 20 can be placed therein. By gentle shaking, pellets 20 then randomly fall through apertures 23 into each of chambers 13 until full. Pellets 20 are conventional lead pellets as sold in various sizes such as 0.177, 0.200, 0.220 and 0.250 caliber (inches). Chambers 13 are sized to receive a 0.177 caliber pellet and of course other chamber sizes for other caliber pellets can be manufactured as desired.

Figure 3B:
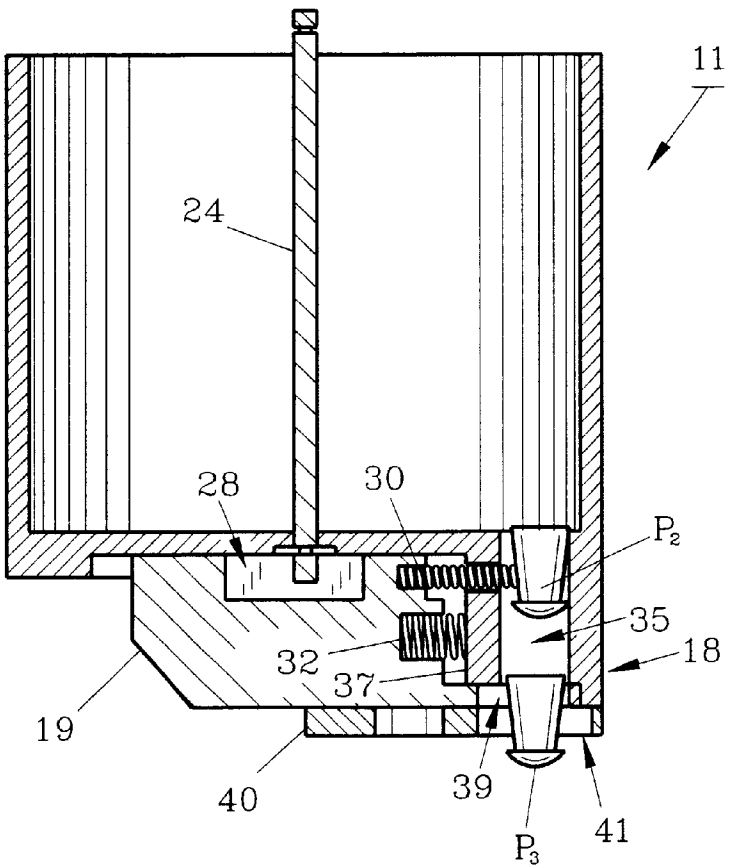
FIG. 3B features the dispenser housing as seen in FIG. 3A with the trigger in a closed or actuated state.

Housing 11 includes bottom 17 having a trigger housing 18, all integrally formed. Trigger 19 is slidably mounted in trigger housing 18 as shown in FIGS. 2, 3A and 3B.

Connecting rod 24 (FIG. 2) formed of stainless steel is provided with stainless steel C-clips 25, 25' which maintain connecting rod 24 in place to hold cylinder 12 in housing 11. Connecting rod 24 extends somewhat downwardly beyond C-clip 25' and resides in slot 28 of trigger 19 when assembled as seen in FIGS. 3A and 3B. Connecting rod 24 thereby guides trigger 19 during use. Resilient member 30 which is preferably a stainless steel coil spring fits within upper channel 31 on trigger 19 whereas resilient member 32 is also a stainless steel coil spring, but has a larger diameter and resides within channel 33 (FIG. 2). Upon assembly resilient member 32 contacts outer wall 37 of exit conduit 35 seen in FIG. 3B to apply return pressure to trigger 19 when actuated. Upon release, trigger 19 moves to its normal or deactuated position as resilient member 32 relaxes or expands. Slot 28 limits the movement of trigger 19 as it contains the terminal end of connecting rod 24, thus preventing excess trigger travel. Resilient member 30, which is a coil spring, passes through opening 36 in outer wall 37 to contact a pellet such as pellet $P_2$ in FIG. 3B. By such contact, pellet $P_2$ is restrained and will not exit trigger aperture 39. When trigger 19 is released, resilient member 32 forces trigger 19 rearwardly (right to left) as seen in FIG. 3A along with resilient member 30, to thereby release pellet $P_2$ and allow it to fall and rest partially on top of aperture 39 of trigger 19. Pellet $P_2$ is then ready to be released upon subsequent actuation of trigger 19 as shown in FIG. 3B. Pellet $P_3$ will then pass through aperture 39 as trigger 19 moves from left to right as shown in FIG. 3B.

Figure 3A:
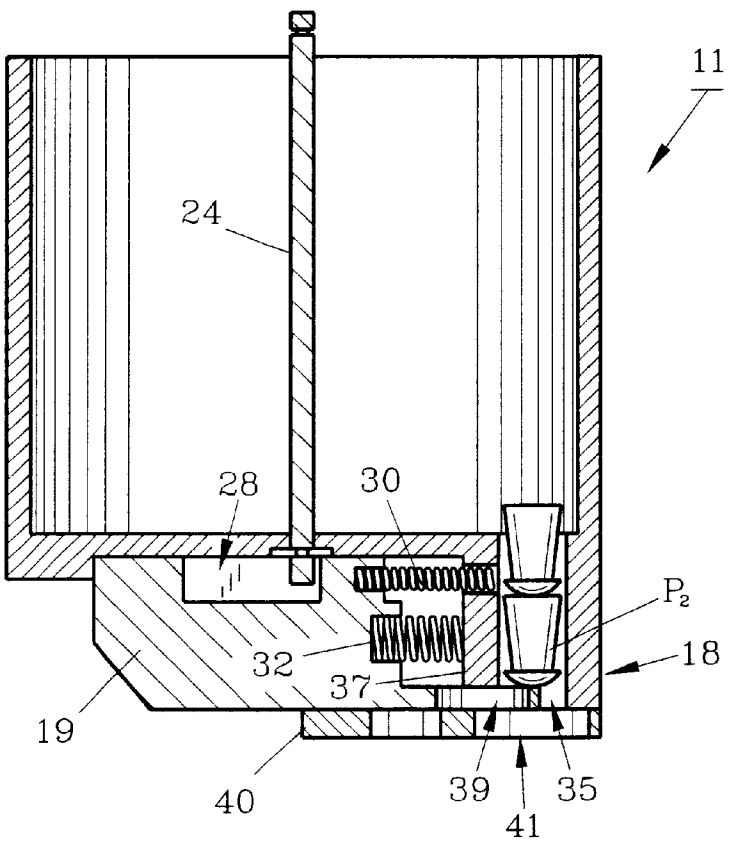
FIG. 3A depicts a cross-sectional view of the dispenser housing with the trigger in a dormant or open state.

Aperture 41 in plate 40 as shown in FIG. 2 is misaligned with aperture 39 of trigger 19 before trigger actuation (see FIG. 3A). When trigger 19 is actuated (FIG. 3B) aperture 39 is brought into coincidental alignment with aperture 41 of plate 40 to allow pellet $P_3$ seen in FIG. 3B to release therefrom. Thus, as trigger 19 is actuated, aperture 39 is brought into alignment with aperture 41 of plate 40, while resilient member 30 engages subsequent pellet $P_2$ in exit conduit 35 as shown in FIG. 3B to prevent simultaneous, multiple pellet dispensing.

Once a chamber 13 (which is aligned with exit conduit 35) is empty the user can then index cylinder 12 manually by rotating hopper 14 by gripping knurled perimeter 43 as shown in FIG. 1 and turning cylinder 12. For accuracy in indexing cylinder 12 so that channels 13 are in precise coincidental alignment with exit conduit 35, detents 45 are defined in cylinder 12 as shown in FIG. 5. Detents 45 are preferably hemispherical in shape and engage sphere 46 as seen in FIG. 2. Sphere 46 is preferably formed from DELRIN (DuPont trademark for acetyl homopolymer) although other suitable polymeric or other materials may be utilized. Sphere 46 is positioned in and protrudes from channel 47. Channel 47 is spring loaded with resilient coil spring 49 which is held in place by stainless steel threaded member 50. Thus, as cylinder 12 is turned, detents 45 engage spherical member 46 contained within channel 47 in succession to provide accurate indexing and positive positioning of cylinder 12 whereby chambers 13 precisely align with exit conduit 35 to insure free passage of pellets 20 therethrough.

The preferred method of using dispensing device 10 includes the steps of removing dispensing device 10 from the belt (not shown) or other location by disengaging clasp 55 as seen in FIG. 1 which is attached to housing 11 preferably by two rivets or a spring retaining clip (not seen). While holding dispensing device 10 in one hand, cap 15 is released from hopper 14 by turning knurled periphery 16 in a counterclockwise direction with the other hand. Once hopper 14 has been opened, pellets 20 can then be placed in quantity in hopper 14. By gently shaking dispensing device 10, pellets 20 will randomly fall into all chambers 13 and each will fill to capacity. The first pellet 20 which falls into chamber 13 (FIG. 2 aligned with exit conduit 35) will pass into exit conduit 35 and rest atop partially exposed trigger aperture 39 (FIG. 3A). After all chambers 13 are filled, any excess pellets 20 can be removed from hopper 14 and returned to a container for storage. Cap 15 is then tightened onto hopper 14 by rotating cap 15 in a clockwise direction. Dispensing device 10 is then replaced and retained on the user's belt or the like with clasp 55. When it is desirous to dispense a pellet 20, trigger 19 is actuated (pressed inwardly) whereby pellet $P_2$ resting on trigger aperture 39 as shown in FIG. 3A will fall from exit conduit 35 and pass through plate aperture 41, as shown by pellet $P_3$ in FIG. 39 and is preferably caught by the user's hand for placement in a pellet pistol (not seen) or the like for firing purposes. Thereafter, by repeatedly depressing trigger 19, all pellets 20 in chamber 13 will be likewise dispensed, one at a time as resilient member 30 engages subsequent pellets 20 which pass into exit conduit 35, as the preceding pellet 20 passes through trigger aperture 39 and plate aperture 41. Once all pellets 20 in one chamber 13 are dispensed, cylinder 12 is manually rotated to the next chamber 13 and is secured in place by engagement of sphere 46 within detent 45. Trigger 19 actuation is repeated to empty that chamber 13. Thus, as each subsequent chamber 13 is emptied, cylinder 12 is rotated and the dispensing process repeated until all pellets 20 within cylinder 12 are dispensed. Cylinder 12 can then be reloaded as described, supra and the dispensing of pellets 20 continued as needed.

The illustrations and examples provided herein are for explanatory purposes to demonstrate the exemplary embodiments and methods and are not intended to limit the scope of the appended claims.

I claim:

1. A pellet dispenser for use with a pellet gun comprising: a housing, a rotatable cylinder, said cylinder contained within said housing, said cylinder defining a plurality of pellet chambers, a hopper, said hopper defining a sloped bottom with a plurality of apertures therein, a trigger, said trigger slidably mounted on said housing in alignment with said chamber, said trigger defining an aperture for releasing a pellet through coincidental alignment with a plate aperture, a trigger plate, said trigger plate proximate said trigger, said trigger plate defining an aperture, said trigger reciprocal with said trigger plate for restraining a pellet by obstructing alignment of said trigger plate aperture, a resilient member, said resilient member contacting said trigger, said resilient member for restraining a pellet from exiting said trigger plate aperture as said trigger is actuated, whereby actuating said trigger allows a pellet to exit from said dispenser for loading a pellet gun.

2. The pellet dispenser of claim 1 further comprising a connecting rod, said connecting rod for holding said rotatable cylinder within said housing.

3. The pellet dispenser of claim 1 further comprising a pair of c-clips, said c-clips attached to said connecting rod for securing said connecting rod to said rotatable cylinder and said housing.

4. The pellet dispenser of claim 1 further comprising a cap, said cap releasably attached to said hopper.

5. The pellet dispenser of claim 4 wherein said cap defines a plurality of knurls, said cap threadably attached to said hopper.

6. The pellet dispenser of claim 1 wherein said trigger is contained within said trigger housing.

7. The pellet dispenser of claim 6 wherein said housing defines an exit conduit, said pellet chamber for selective coincidental alignment with said exit conduit for passage of pellets therethrough.

8. A pellet dispenser for use in loading a pellet gun comprising:

a housing, a bottom, said bottom attached to said housing, said bottom defining an exit conduit, a cylinder, said cylinder rotatably positioned in said housing, said cylinder defining a plurality of pellet chambers, said pellet chambers for selective coincidental alignment with said exit conduit, a hopper, said hopper defining a sloped bottom and a plurality of apertures, circumferentially spaced therein, said bottom sloped toward said apertures, said hopper positioned within said housing atop said cylinder, a trigger housing, a trigger, said trigger mounted in said trigger housing, a trigger plate, said trigger plate proximate said trigger, said trigger plate defining an aperture, said trigger reciprocal with said trigger plate for restraining a pellet by obstructing alignment of said trigger plate aperture, a resilient member, said resilient member contacting said trigger, said resilient member for restraining a pellet from exiting said plate aperture as said trigger is actuated, whereby a pellet will pass through said plate aperture upon actuation of said trigger for loading in the pellet gun.

9. The pellet dispenser of claim 8 further comprising a belt clip, said belt clip affixed to said housing to allow the pellet dispenser to be worn on the clothing of the user.

10. The pellet dispenser of claim 9 further comprising a cap, said cap for releasable attachment with said hopper.

11. A method of dispensing pellets for loading in a pellet gun utilizing a dispenser having a hopper with a sloped bottom and apertures aligned with a plurality of pellet chambers defined by a rotatable cylinder positioned in a housing below the hopper, said housing having an exit conduit with a trigger proximate thereto, the trigger having an aperture and reciprocal with a trigger plate for restraining a pellet by obstructive alignment with an aperture in said trigger plate, said method comprising the steps of:

a) shaking the dispenser to urge pellets in said hopper to enter said cylinder chambers through said hopper apertures;

b) rotating a first cylinder chamber into coincidental alignment with the exit conduit; and c) activating the trigger to allow a pellet contained within said chamber to transgress said exit conduit as said trigger aperture coincidentally aligns with said plate aperture for loading in a pellet gun; and d) restraining a second pellet from dropping through the trigger aperture upon engagement of the trigger.

12. The method of claim 11 further comprising the step of loading the hopper with pellets.

13. The method of claim 11 wherein rotating a first chamber comprises the step of manually rotating the cylinder.

14. The method of claim 11 further comprising the step of resiliently engaging a pellet contained within said exit conduit to restrain the same.

* * * * *